US010548373B2

(12) United States Patent
Sorensen

(10) Patent No.: US 10,548,373 B2
(45) Date of Patent: Feb. 4, 2020

(54) SYSTEMS AND METHODS FOR A SIDE-LOADING STRAP BUCKLE

(71) Applicant: NITE IZE, INC., Boulder, CO (US)

(72) Inventor: Joe Sorensen, Bend, OR (US)

(73) Assignee: Nite Ize, Inc., Boulder, CO (US)

( * ) Notice: Subject to any disclaimer, the term of this patent is extended or adjusted under 35 U.S.C. 154(b) by 0 days.

(21) Appl. No.: 15/914,987

(22) Filed: Mar. 7, 2018

(65) Prior Publication Data

US 2018/0255881 A1 Sep. 13, 2018

Related U.S. Application Data

(60) Provisional application No. 62/600,961, filed on Mar. 7, 2017.

(51) Int. Cl.

| | |
|---|---|
| ***A44B 11/06*** | (2006.01) |
| ***A44B 11/10*** | (2006.01) |
| *A44B 11/04* | (2006.01) |

(52) U.S. Cl.

CPC ..... *A44B 11/065* (2013.01); *A44B 11/10* (2013.01); *A44B 11/04* (2013.01); *Y10T 24/4093* (2015.01)

(58) Field of Classification Search

CPC ... A44B 11/04; A44B 11/065; Y10T 24/4093; Y10T 24/4088; Y10T 24/2164; Y10T 24/2192; Y10T 24/2194; Y10T 24/3927; Y10T 24/3916

See application file for complete search history.

(56) References Cited

U.S. PATENT DOCUMENTS

| | | | | | |
|---|---|---|---|---|---|
| 411,777 | A | * | 10/1889 | Behrens | A44B 11/04 24/169 |
| 685,831 | A | * | 11/1901 | Frawley | F16L 33/02 24/200 |
| 1,636,925 | A | * | 7/1927 | Ravigneaux | A44B 11/04 24/200 |
| 1,853,889 | A | * | 4/1932 | Alterson | A44B 11/04 24/312 |
| 1,860,170 | A | * | 5/1932 | Bronson | A44B 11/04 24/198 |
| 2,326,328 | A | | 8/1943 | Bush | |
| 2,585,619 | A | * | 2/1952 | Becker | A44B 11/25 152/237 |
| 2,648,112 | A | * | 8/1953 | Neumann | A44B 11/04 24/168 |

(Continued)

OTHER PUBLICATIONS

International Search Report and Written Opinion dated May 15, 2018 issued in related PCT Patent App. No. PCT/US2018/021416 (14 pages).

*Primary Examiner* — Robert Sandy
*Assistant Examiner* — Michael S Lee
(74) *Attorney, Agent, or Firm* — Haynes and Boone, LLP

(57) ABSTRACT

A tensioning device includes a first slot located on a first end of the tensioning device, the first slot being closed on all four sides. The tensioning device further includes a second slot and a third slot, the third slot located on a second end of the tensioning device, the second end opposite the first end, the second slot located between the first and third slot, the second and the third slot being having an open side on one of four sides and closed on three of four sides. The tensioning device further includes a lever arm, the lever arm located on the second end of the tensioning device.

24 Claims, 5 Drawing Sheets

(56) References Cited

U.S. PATENT DOCUMENTS

| | | | | | |
|---|---|---|---|---|---|
| 3,161,931 | A | * | 12/1964 | Jehiel | A41F 1/006 24/200 |
| 3,203,058 | A | | 8/1965 | Roing | |
| 3,242,542 | A | | 3/1966 | Tako | |
| 3,858,279 | A | * | 1/1975 | Brattstrom | B65D 63/16 24/68 F |
| 5,432,985 | A | | 7/1995 | Bernart | |
| 5,733,004 | A | * | 3/1998 | Celestina-Krevh | B60N 2/26 24/197 |
| 5,784,763 | A | * | 7/1998 | Cassidy | F16G 11/14 24/129 B |
| 2005/0066484 | A1 | * | 3/2005 | Hum | A44B 11/04 24/321 |
| 2005/0086772 | A1 | | 4/2005 | Yoshiguchi | |
| 2011/0016676 | A1 | * | 1/2011 | Gray | B60P 7/0869 24/571 |

* cited by examiner

SYSTEMS AND METHODS FOR A SIDE-LOADING STRAP BUCKLE

CROSS-REFERENCE TO RELATED APPLICATIONS

This application claims the benefit of U.S. Provisional Application No. 62/600,961, filed Mar. 7, 2017, the entirety of which is hereby incorporated by reference.

BACKGROUND

Strap buckles have been in common use for many years. Typical of these is U.S. Pat. No. 1,234,818 (1917), which describes a buckle mounted on a strap. The user threads the end of the strap around the object being secured, through the buckle past a movable member, and then back the other direction through the buckle past an adjacent, fixed member. This action holds the strap in position within the buckle, forming a loop around the object being secured. Tension is added by pulling on the strap end. Some newer devices utilize fixed buckle members oriented such that they pinch the strap to maintain tension. The end of the strap is pulled to increase tension, but the buckle member orientation prevents movement of the strap in the opposite direction. Other devices employ spring-loaded cams or ratchets to maintain tension on a strap.

In spite of their widespread use, these devices share common problems, namely: (a) the user must locate the end of the strap and then thread it all the way through the buckle in a first direction, and some devices require the user to thread it back again through the buckle in the opposite direction, (b)—tension can be difficult to release because the release mechanism is typically located along the centerline of the strap, and thus offers little leverage for this purpose, (c)—even after tension is released, the strap must be fully withdrawn in one or both directions from the buckle before the strap can be removed from the object being secured.

It would therefore be advantageous to provide a buckle that allows loading the strap onto the buckle without having to thread the entire strap in one or both directions through the buckle. It would be further advantageous to provide a buckle that offers an easy to release structure. It would be further advantageous to provide a buckle that allows for ease of removal of the buckle.

BRIEF SUMMARY

In one embodiment, an improved Side-Loading Strap Buckle System is disclosed, which (A)—allows loading of the strap onto the side of the buckle, (B)—has a leveraged release structure, (C)—allows unloading of the strap from the side of the buckle, and in one alternative, (D)—incorporates an elastomer section for improved holding and release of the object being secured. In another embodiment, two side-loading buckles are provided, which allow use on a loop of strap without the need to permanently attach either buckle to the strap.

In one embodiment, a tensioning device includes a first slot located on a first end of the tensioning device, the first slot being closed on all four sides. The tensioning device further includes a second slot and a third slot, the third slot located on a second end of the tensioning device, the second end opposite the first end, the second slot located between the first and third slot, the second and the third slot being having an open side on one of four sides and closed on three of four sides. The tensioning device further includes a lever arm, the lever arm located on the second end of the tensioning device. Optionally, the tensioning device includes a raised area, located adjacent to the second and third slots, such that the second and third slots are raised in relation to the first slot. In one alternative, the open side of the second and the third slot are on the same side of the one of four sides. In another alternative, the first, second, and third slot are shaped to receive a flat strap. Optionally, the flat strap is standard size. Alternatively, the flat strap is made of nylon webbing. In another alternative, the tensioning device includes a first retention tab proximate to the second slot, the retention tab narrowing the width of the open side of the second slot. In yet another alternative, the tensioning device includes a second retention tab proximate to the third slot, the second retention tab narrowing the width of the open side of the third slot. Optionally, the first, second, and third slot are all arranged parallel to each other.

In one embodiment, a tensioning system includes a tensioning device, including a first slot located on a first end of the tensioning device, the first slot being closed on all four sides. The tensioning device further includes a second slot and a third slot, the third slot located on a second end of the tensioning device, the second end opposite the first end, the second slot located between the first and third slot, the second and the third slot being having an open side on one of four sides and closed on three of four sides. The tensioning device further includes a lever arm, the lever arm located on the second end of the tensioning device. The tensioning system further includes a first strap having a first end oriented and anchored in the first slot. Optionally, the tensioning system includes a raised area, located adjacent to the second and third slots, such that the second and third slots are raised in relation to the first slot. Alternatively, the second and third slot are arranged parallel to each other and the first slot is arranged such that an end of the first slot closest to the open side of the second slot is closer to the second slot than an end of the first slot furthest from the open side of the second slot. In one alternative, the open side of the second and the third slot are on the same side of the one of four sides. In another alternative, the first, second, and third slot are shaped to receive a flat strap. Optionally, the first slot is at a one to ten degree angle to the second slot. Alternatively, the first slot is at a four degree angle to the second slot. Optionally, the system further includes a carabiner gate oriented to close the open end of the second slot.

In one embodiment, a method of using a tensioning system includes providing a tensioning system. The tensioning system includes a tensioning device, including a first slot located on a first end of the tensioning device, the first slot being closed on all four sides. The tensioning device further includes a second slot and a third slot, the third slot located on a second end of the tensioning device, the second end opposite the first end, the second slot located between the first and third slot, the second and the third slot being having an open side on one of four sides and closed on three of four sides. The tensioning device further includes a lever arm, the lever arm located on the second end of the tensioning device. The tensioning system further includes a first strap having a first end oriented and anchored in the first slot. The method further includes looping the first strap. The method further includes wrapping the first strap around an object. The method further includes placing the first strap on the second and third slot of the tensioning device from the open side of the second and third slot. The method further includes tensioning the first strap around the object by pulling on the strap. Optionally, the method further includes lifting the lever arm to release the tension on the first strap. Optionally, the method further includes removing the first strap from tensioning device by sliding the first strap through the open side of the second and third slot.

DETAILED DESCRIPTION

Certain terminology is used herein for convenience only and is not to be taken as a limitation on the embodiments of the systems and methods for a side-loading strap buckle system (the "device"). In many embodiments, the side-loading strap buckle system includes a variety of slots for receiving and tensioning a strap. In many embodiments, the device includes a first slot to which a strap may be affixed. In many configurations, this is a permanently attached strap. In many embodiments, the device further includes a first and second side load slot. These side load slots are open on one side, such that a strap may be easily slid onto the device and tensioned. The side load slots are located in a raise portion of the device in comparison to the first slot. Additionally, the device may include a lever arm that allows the user to release the tension of the device on the strap. The lever arm, in combination with the raised slot area, provides for release by rotation of the device, such that the edge of the device is moved away from the strap, allowing it to slide more freely.

Figure 1:
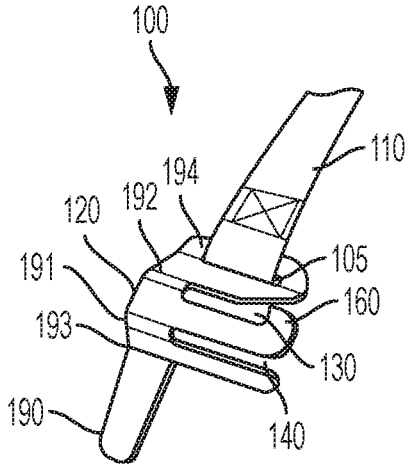
FIG. 1 shows one embodiment of a side-loading strap buckle system attached to one end of a strap, in position to secure an object.
Figure 2:
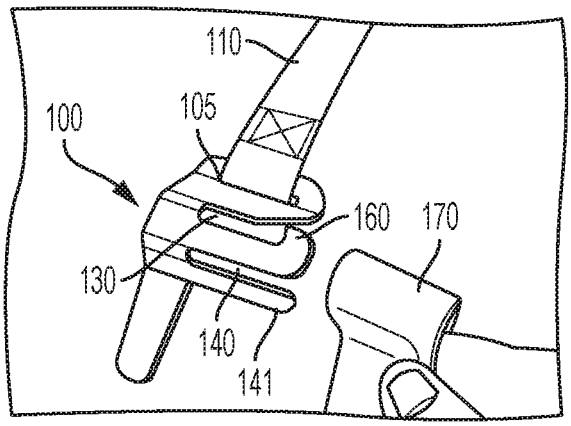
FIG. 2 shows a user forming a loop in the other end of the strap, for insertion onto the side-loading strap buckle system of FIG. 1 from the right side.
Figure 3:
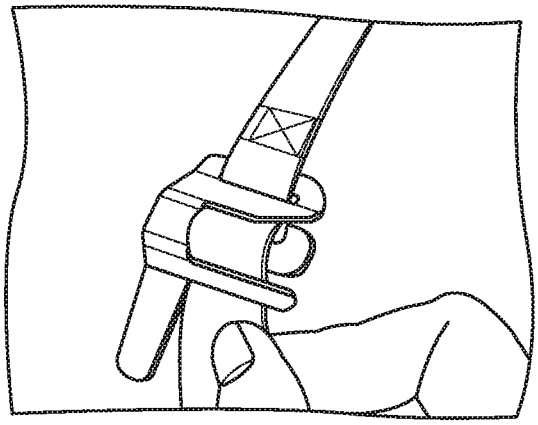
FIG. 3 shows the strap after insertion into the side-loading strap buckle system of FIG. 1, and the user adding tension by pulling downward.

A side-loading strap buckle system is disclosed which constitutes a strap tensioning system. In one embodiment as shown in FIGS. 1-3, the device 100 has a slot 105 for attachment to a strap 110. A raised area 120 is adjacent to a second slot 130 and a third slot 140. Release lever 190 is positioned below and to the side of slots 130 and 140.

Figure 4:
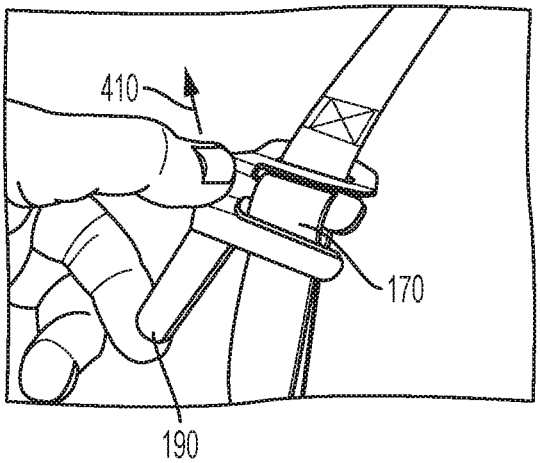
FIG. 4 shows a user pulling upwards on the release lever with his index finger, to release tension on the side-loading strap buckle system of FIG. 1.
Figure 5:
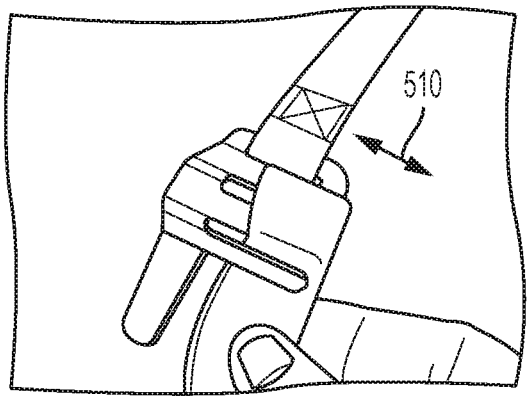
FIG. 5 shows a user removing the strap to the right side of the side-loading strap buckle system of FIG. 1.

In use, the strap 110 is passed around the object to be secured. A loop 170 is formed at a convenient spot along the strap 110. Loop 170 is then inserted into the device 100 at slots 130 and 140. Retention tab 160 assures that loop 170 stays within slots 130 and 140 as strap 110 is pulled in the direction of the release lever 190 to tighten the strap. To release tension from the system as shown in FIGS. 4-5, the user pulls release lever 190 upwards in direction 410, and then removes the loop of strap 170 from the device 100 in direction 510. Edge 141 typically rests on strap 110 and provides tension against the surface under the device 100. By pulling up on the release lever 190, edge 141 is pulled off of strap 110 and it is easier to release strap 110. Due the arrangement of raised area 120, pressure is primarily put on the strap 110 at edge 141 until the pressure is released via lever arm 190.

In many embodiments, raised area 120 is formed via making bends in the device 100 that coincide with slot 130 and 140 such that the area between them is raised. This forms an approximate half hexagonal shape for the device 100. In FIG. 1, bends 191, 192 provide for the formation of the raised area 120.

Figure 6:
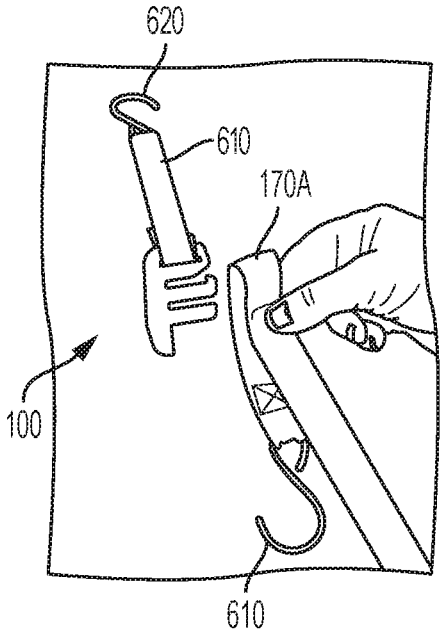
FIG. 6 shows another embodiment of a side-loading strap buckle system, with an elastic section of strap.

In another embodiment as shown in FIG. 6, strap 610 has is made of elastic material and a hook 620 mounted at the distal end of the elastic material. Strap 170A has a hook 620 mounted at its distal end. This arrangement serves as a side-loading, adjustable-length replacement for a bungee cord. Release lever 190 allows for the slow, controlled release of tension from the system, in contrast with common bungee cords, which are dangerous because of their uncontrolled, explosive release.

Figure 7:
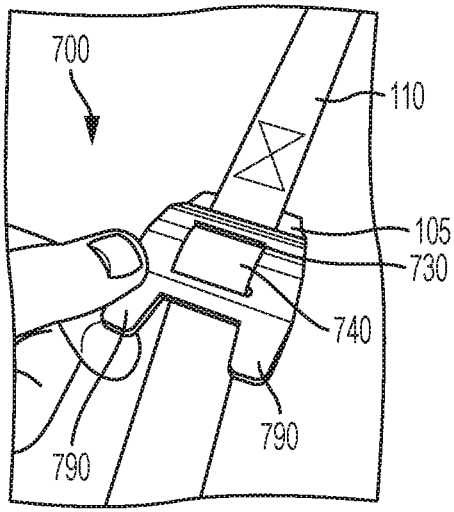
FIG. 7 shows another embodiment of a side-loading strap buckle system with release levers on both sides.
Figure 8:
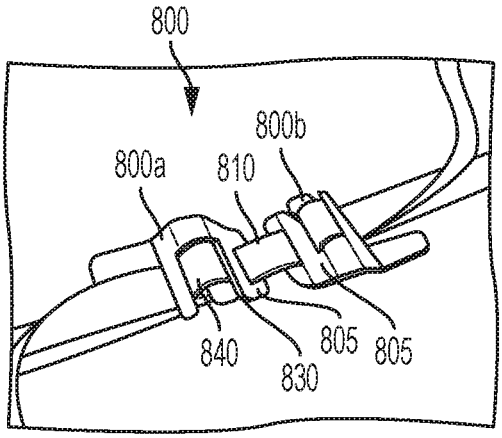
FIG. 8 shows another embodiment of a side-loading strap buckle system with mirror-image buckles.

Another embodiment of a device 700 shown in FIG. 7 has a release lever 790 on both sides. Device 700 similarly includes a first slot 105 and a second slot 730 and a third slot 740. Second slot 730 and third slot 740 are typically not open to the side in this arrangement. In another embodiment, device 800, as shown in FIG. 8, two buckles 800*a*, 800*b* are connected by hinge means 810. In this embodiment, one of the buckles can be mounted from the side anywhere along a length of strap. The strap can then be passed around the object to be secured, mounted to the second buckle, and then tension can be added to the strap from either or both buckles. Hinge means 810 allows for raising one or the other release lever 190, thus releasing tension from both buckles 800*a*, 800*b*. As shown, each buckle 800*a*, 800*b* includes a first slot 805 for the attachment of the hinge means 810. Hinge means 810 may be a sewn together strap, a resilient plastic piece, or some other material placed between the buckles 800*a*, 800*b* to hold them together. Additionally, each buckle 800*a*, 800*b* includes a second and third slot 830, 840 for releasably attaching a strap.

Figure 9:
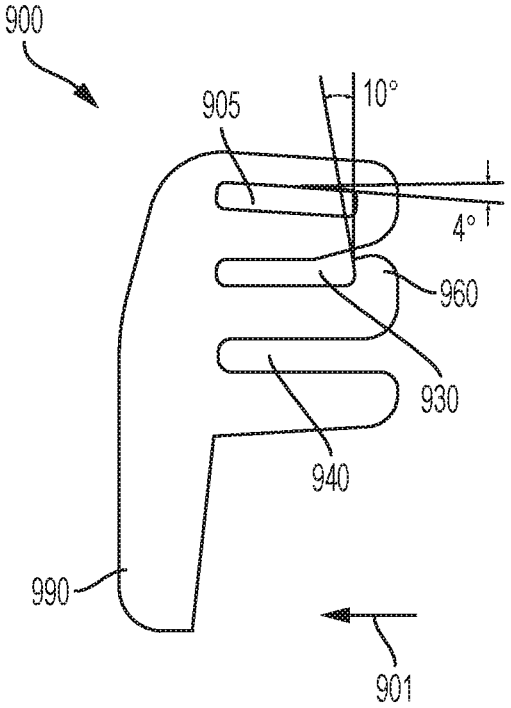
FIG. 9 shows one embodiment of an improved strap retention slot.

In another embodiment of a device 900 as shown in FIG. 9, the upper edge of strap retention slot 905 is angled slightly in relation to slots 930 and 940, as is the inner edge of retention tab 960. When tension is applied to the strap system, angled slot 905 causes the buckle to shift in the direction of arrow 901. These angles help retention tab 960 maintain strap loop 170 in slots 930, 940. Device 900 also includes lever arm 990. In the image shown, the raised portion of slots 930, 940 (as in the other embodiments shown in relation to FIGS. 1-8) is not shown, but in many configurations is included.

Figure 10:
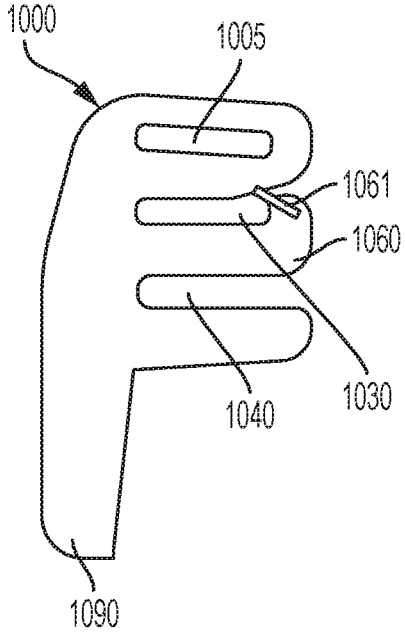
FIG. 10 shows the retention tab with a wire-gate carabiner.

In still another embodiment, a device 1000 as shown in FIG. 10, a wire-gate carabiner 1061 has been added to slot 1060, to help prevent premature removal of strap loop 170 to the side in the event of slack tension in the strap. Device 1000 further includes slots 1005, 1030, 1040 and lever 1090. As in the embodiment of FIG. 9, slot 1005 is angled in relation to slots 1030, 1040. In the image shown, the raised portion of slots 1030, 1040 (as in the other embodiments shown in relation to FIGS. 1-8) is not shown, but in many configurations is included.

In many embodiments, the side-loading strap buckle system is designed to work with flat straps. In many configurations, the flat straps are of standard one inch thickness. The slots are typically sized to accommodate these flat straps. However, flat straps come in various sizes, including but not limited to, sizes ranging from a quarter inch in width to two or more inches in width.

Figure 11:
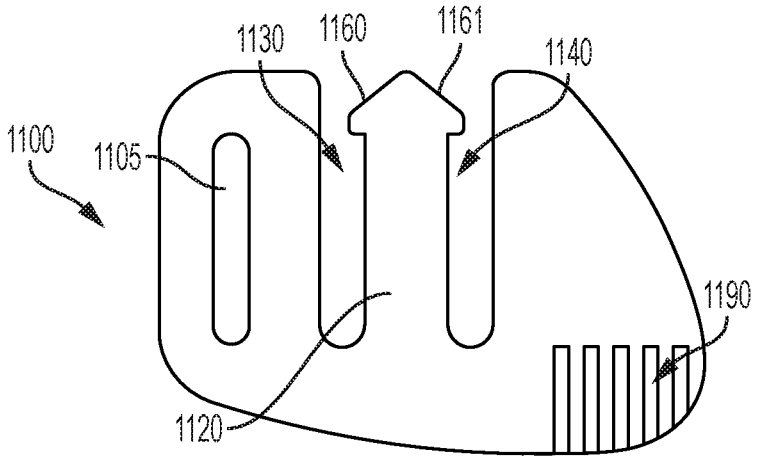
FIG. 11 shows another embodiment of a side-loading strap buckle.
Figure 12:
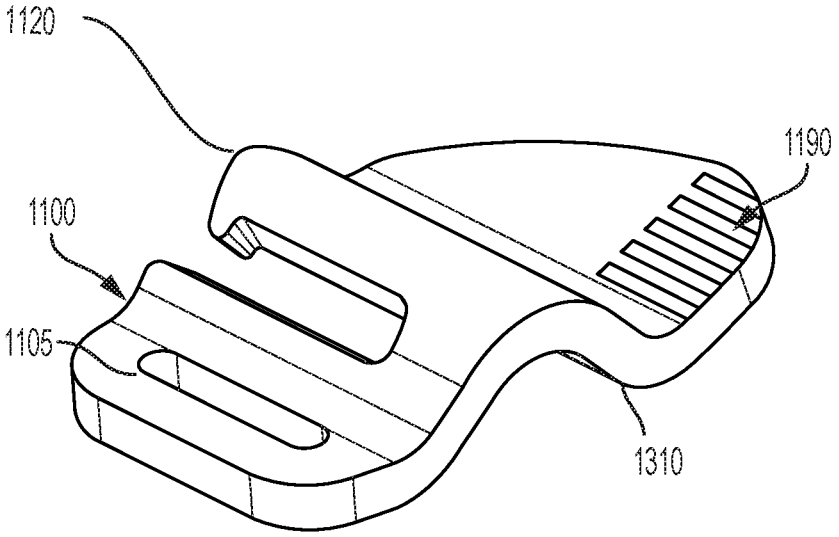
FIG. 12 shows a perspective view of the side-loading strap buckle of FIG. 11.

Another embodiment of a side-loading strap buckle system is shown in FIG. 11. In this diagram a similar first slot 1105 is shown in device 1100. This slot 1105, as before, may receive a flat strap. The flat strap may be permanently affixed to the first slot 1105. Similar to the previous embodiments, device 1100 includes a second slot 1130 and a third slot 1140. Second slot 1130 and third slot 1140 are on either side of raised area 1120. The orientation of raised area 1120 makes it easier to attach a looped end of a flat strap, since it may be easily passed over the raised area 1120 from the side. The raised area 1120 includes retention tabs 1160 and 1161. The rounded/diagonal shape of the retention tabs (arrow shape) provides for ease of placement of the flat strap, however, the opposite side of the arrow provides a tab for holding the flat strap in place. Release lever 1190 in device 1100 takes a somewhat different form as an ergonomic press tab. FIG. 12 shows a perspective view of the device 1100.

Figure 13:
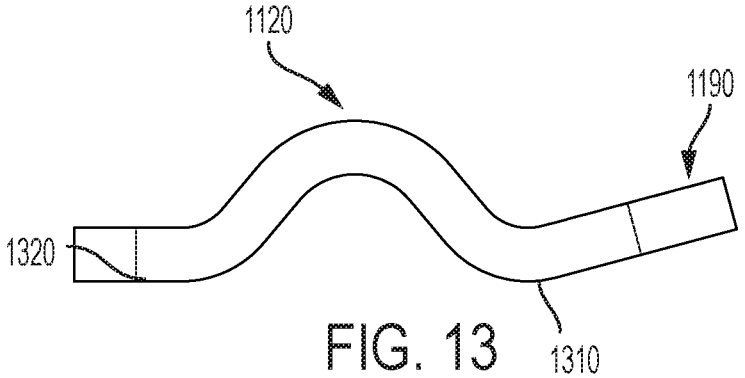
FIG. 13 shows a side view of the side-loading strap buckle of FIG. 11.

FIG. 13 shows a side view of device 1100. In this view the side profile of the device is visible. It is of note in this view that bottom edge 1320 generally sits flat when the device 1100 is in use. The flat straps generally are trapped at edge 1310 under the device 1100. Since release lever 1190 tilts upwards, it is convenient for the user to reach under release lever 1190 and pull upwards to release the flat straps from edge 1310 as previously discussed.

Figure 14:
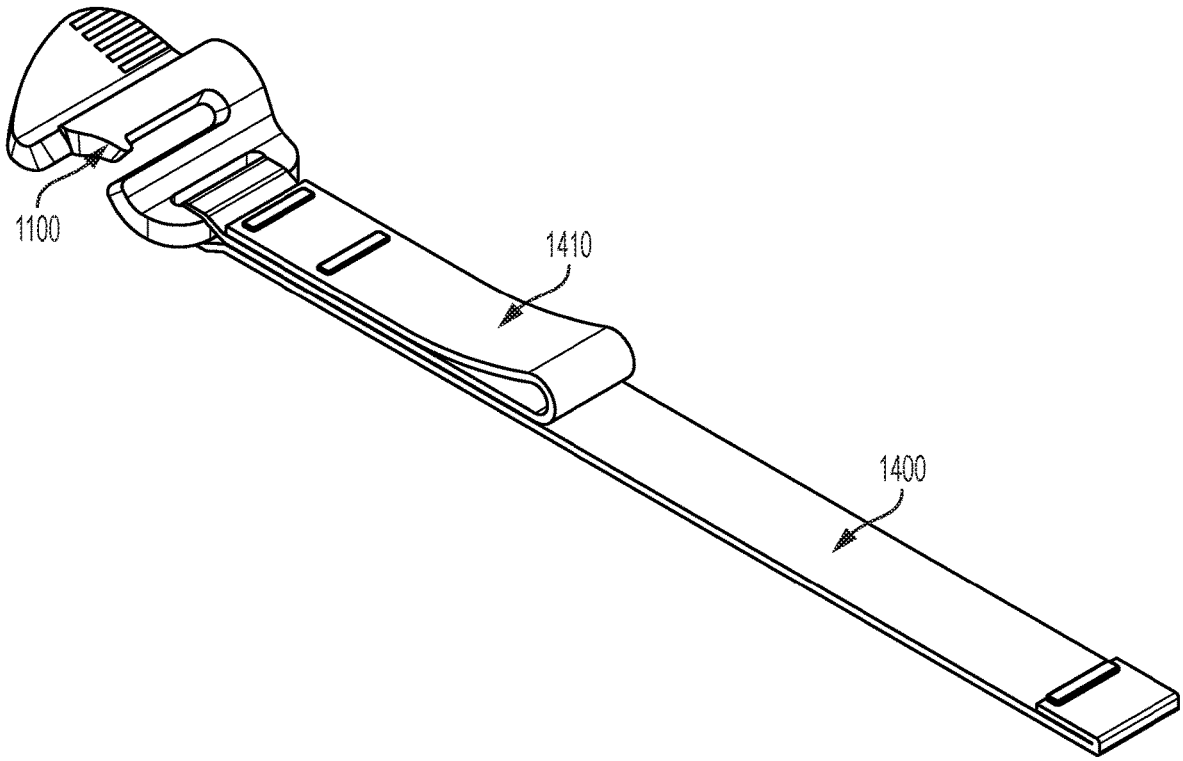
FIG. 14 shows the side-loading strap buckle of FIG. 11 with a strap attached.

FIG. 14 shows a flat strap 1400 attached to device 1100 as previously discussed. In use, flat strap 1400 could be the approximate length shown or much longer and the length shown is merely exemplary. Flat strap 1400 also includes loop 1410, which may provide for a variety of uses. For instance, if the strap is wrapped around a bundle or other object and tensioned using device 1100, loop 1410 may be used as a handle for carrying. Additionally, loop 1410 may be used for tightening and a variety of other functions.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A tensioning device comprising:

a first slot located on a first end of the tensioning device, the first slot being closed on all four sides;

a second slot and a third slot, the third slot located on a second end of the tensioning device, the second end opposite the first end, the second slot located between the first and third slot, the second and the third slot having an open side on one of four sides and closed on three of four sides;

a lever arm, the lever arm located on the second end of the tensioning device;

a first edge at a change in curvature between the first and second slots; and a second edge at a change in curvature between the third slot and the lever arm.

2. The tensioning device of claim 1, further comprising:

a raised area, located adjacent to the second and third slots, such that the second and third slots are raised in relation to the first slot.

3. The tensioning device of claim 2, wherein the open side of the second and the third slot are on the same side of the one of four sides.

4. The tensioning device of claim 3, wherein the first, second, and third slot are shaped to receive a flat strap.

5. The tensioning device of claim 4, wherein the flat strap is a standard one-inch size.

6. The tensioning device of claim 4, wherein the flat strap is made of nylon webbing.

7. The tensioning device of claim 4, further comprising: a first retention tab proximate to the second slot, the retention tab narrowing the width of the open side of the second slot.

8. The tensioning device of claim 7, further comprising: a second retention tab proximate to the third slot, the second retention tab narrowing the width of the open side of the third slot.

9. The tensioning device of claim 8, wherein the first, second, and third slot are all arranged parallel to each other.

10. The tensioning device of claim 2, wherein the tensioning device is bent or curved between the first and second edges to define the raised area.

11. The tensioning device of claim 10, wherein the tensioning device is shaped arcuately in cross-section between the first and second edges.

12. A tensioning system comprising:

a tensioning device, including a first slot located on a first end of the tensioning device, the first slot being closed on all four sides;

a second slot and a third slot, the third slot located on a second end of the tensioning device, the second end opposite the first end, the second slot located between the first and third slot, the second and the third slot being having an open side on one of four sides and closed on three of four sides;

a lever arm, the lever arm located on the second end of the tensioning device;

a first edge at a change in curvature between the first and second slots; and a second edge at a change in curvature between the third slot and the lever arm; and a first strap having a first end oriented and anchored in the first slot.

13. The tensioning system of claim 12, further comprising:

a raised area, located adjacent to the second and third slots, such that the second and third slots are raised in relation to the first slot.

14. The tensioning system of claim 13, wherein the second and third slot are arranged parallel to each other and the first slot is arranged such that an end of the first slot closest to the open side of the second slot is closer to the second slot than an end of the first slot furthest from the open side of the second slot.

15. The tensioning system of claim 14, wherein the open side of the second and the third slot are on the same side of the one of four sides.

16. The tensioning system of claim 15, wherein the first, second, and third slot are shaped to receive a flat strap.

17. The tensioning system of claim 16, wherein the first slot is at a one to ten degree angle to the second slot.

18. The tensioning system of claim 17, wherein the first slot is at a four degree angle to the second slot.

19. The tensioning system of claim 18, further comprising a carabiner gate oriented to close the open end of the second slot.

20. The tensioning system of claim 12, wherein:

the first and second edges define a plane; and the first slot is located within the plane.

21. The tensioning system of claim 20, wherein:

the tensioning device is bent or curved between the first and second edges to define a raised area such that the second and third slots are raised in relation to the plane; and the lever arm extends away from the plane and towards the raised area.

22. A method of using a tensioning system, the method comprising:

providing a tensioning system, the tensioning system including a tensioning device, including: a first slot located on a first end of the tensioning device, the first slot being closed on all four sides; a second slot and a third slot, the third slot located on a second end of the tensioning device, the second end opposite the first end, the second slot located between the first and third slot, the second and the third slot having an open side on one of four sides and closed on three of four sides; a lever arm, the lever arm located on the second end of the tensioning device; a first edge at a change in curvature between the first and second slots; and a second edge at a change in curvature between the second and third slots; and a first strap having a first end oriented and anchored in the first slot;

looping the first strap;

wrapping the first strap around an object;

placing the first strap on the second and third slot of the tensioning device from the open side of the second and third slot; and tensioning the first strap around the object by pulling on the strap.

23. The method of claim 22, further comprising:

lifting the lever arm to release the tension on the first strap.

24. The method of claim 23, further comprising:

removing the first strap from tensioning device by sliding the first strap through the open side of the second and third slot.

* * * * *